United States Patent [19]

Katsukawa

[11] Patent Number: 4,842,431

[45] Date of Patent: Jun. 27, 1989

[54] MULTI-SPEED COOLING FAN FOR PRINTING DEVICE

[75] Inventor: Satoshi Katsukawa, Ichinomiya, Japan

[73] Assignee: Brother Kogyo Kabushiki Kaisha, Nagoya, Japan

[21] Appl. No.: 107,100

[22] Filed: Oct. 13, 1987

[30] Foreign Application Priority Data

Oct. 15, 1986 [JP] Japan ..... 61-244936
Nov. 18, 1986 [JP] Japan ..... 61-274574

[51] Int. Cl.[4] ..... B41J 29/00
[52] U.S. Cl. ..... 400/719; 400/679
[58] Field of Search ..... 400/124, 679, 719; 318/333, 334

[56] References Cited

U.S. PATENT DOCUMENTS

| | | | |
|---|---|---|---|
| 4,265,337 | 5/1981 | Dammeyer | 318/333 X |
| 4,496,824 | 1/1985 | Kawai et al. | 400/719 X |
| 4,540,295 | 9/1985 | Okunishi et al. | 400/719 X |
| 4,541,747 | 9/1985 | Imaizumi et al. | 400/719 X |
| 4,574,226 | 3/1986 | Binder | 318/334 X |
| 4,639,650 | 1/1987 | Nakai | 400/719 X |
| 4,664,542 | 5/1987 | Tsugita | 400/719 X |

FOREIGN PATENT DOCUMENTS

| | | | |
|---|---|---|---|
| 3318784 | 11/1984 | Fed. Rep. of Germany | 400/719 |
| 0151583 | 11/1981 | Japan | 400/719 |
| 0178992 | 10/1984 | Japan | 318/334 |
| 0018379 | 1/1985 | Japan | 400/719 |
| 0083873 | 5/1985 | Japan | 400/719 |
| 0245578 | 12/1985 | Japan | 400/719 |

*Primary Examiner*—Ernest T. Wright, Jr.
*Attorney, Agent, or Firm*—Dennison, Meserole, Pollack & Scheiner

[57] ABSTRACT

A cooling fan control device for regulating the speed of a fan cooling a printing device. The control includes apparatus for determining whether a printing head and a paper feeder are to be driven, and when at least one of the printing head or paper feeder is to be driven, the cooling fan is driven at a high speed, while when neither the printing head nor the paper feeder is to be driven, the cooling fan is driven at a low speed. In a further aspect, the printing device sequentially adds the number of dots printed to a value previously stored in a memory and a subtracting device subtracts a predetermined value from the dot number newly stored in the memory every predetermined time. A comparison is made to determine whether the updated dot number stored in the memory is equal to or less than the reference value, and the cooling fan control operates in such a manner that if the updated dot number is more than the reference value, the cooling fan continues to be rotated at a fixed speed, while on the other hand, when the updated dot number is equal to or less than the reference value, the rotating speed is reduced or nullified.

8 Claims, 6 Drawing Sheets

MULTI-SPEED COOLING FAN FOR PRINTING DEVICE

BACKGROUND OF THE INVENTION

The present invention relates to a printing device provided with a cooling fan control device for controlling a cooling fan for cooling the printing device.

A conventional dot printer includes a cooling fan for cooling a printing head, various motors and a power supply unit, etc., so as to prevent an increase in temperature in the printer due to heat generation from these members. A control method of the cooling fan is such that the cooling fan starts its rotation at the same time power is supplied to the printer, and the rotation of the cooling fan is continued at a fixed speed until power is cut off. Alternatively, a driving motor for the cooling fan is rotated in cooperation with a carriage driving motor, so that the cooling fan is rotated only when the carriage is moved during the print operation. These conventional control methods are disclosed in Japanese Laid Open publication Nos. 60-18379 and 60-83873.

In the first control method where the cooling fan continues to be rotated while power is supplied to the printer, the cooling fan is rotated at the same speed even at idling, that is, under the condition where power is on, but neither the print operation nor the paper feed operation is conducted. As a result, there occurs a problem that noise of the cooling fan during idling is increased. On the other hand, in the second control method where the cooling fan is rotated only during the print operation, there occurs a problem that the temperature of the heat generating element in the printer such as the printing head cannot be decreased to a desired temperature by rotating the cooling fan only during the print operation when an amount of heat generated from the printing head or the other members is large prior to the end of the print operation.

SUMMARY OF THE INVENTION

It is a first object of the present invention to provide a printing device having a cooling fan control device which desirably rotates a cooling fan.

It is a second object of the present invention to provide a printing device having a cooling fan control device which rotates the cooling fan at a high speed while the amount of heat generated in the printing device is large, and on the other hand, rotates the cooling fan at a low speed or stops same while the amount of heat generated is small.

It is a third object of the present invention to provide a printing device having a cooling fan control device which continues a high-speed rotation of the cooling fan for a period of time required for cooling the printing device when the temperature of the printing head or the like is yet high even after the print operation such as just after the print operation and the paper feed operation.

It is a fourth object of the present invention to provide a printing device which rotates the cooling fan at a low speed when neither the print operation nor the paper feed operation is conducted, and the amount of heat generated in the printing device is small, thereby preventing an increase in temperature due to the relatively small heat generated from a power supply circuit or the like, and reducing noise from the cooling fan.

According to one aspect of the present invention, there is provided a cooling fan control device having a determining means for determining whether or not a printing head moving means and a paper feeding means are driven, wherein when it is determined by the determining means that at least one of the printing head moving means and the paper feeding means is driven, the cooling fan is driven at a high speed (which will be also called a rated speed), while when it is determined that neither the printing head moving means nor the paper feeding means is driven, the cooling fan is driven at a speed lower than the rated speed.

In the print operation and/or the paper feed operation where at least one of the printing head moving means and the paper feeding means is driven, the cooling fan is driven at the rated speed. On the other hand, when the printing device is at idling where neither the printing head moving means nor the paper feeding means is driven, the cooling fan is driven at a speed lower than the rated speed. Accordingly, the printing device is cooled even at idling, and noise from the cooling fan may be reduced.

According to another aspect of the present invention, there is provided a printing device comprising an adding means for sequentially adding the number of dots printed by the print operation of the printing head to a value previously stored in a memory, a time counting means for counting time, a subtracting means for subtracting a predetermined value from the dot number newly stored in the memory every predetermined time counted by the time counting means, a determining means for comparing the updated dot number stored in the memory with a reference value and determining whether the updated dot number is equal to or less than the reference value, and a cooling fan control means for controlling a cooling fan in such a manner that when it is determined that the updated dot number is more than the reference value, the cooling fan continues to be rotated at a fixed speed, while when it is determined that the updated dot number is equal to or less than the reference value, the rotating speed of the cooling fan is nullified or reduced.

When the printing head moving device is operated to move the printing head and/or the paper feeding device is operated to feed the printing paper to start the print operation, the adding means operates to sequentially add the printed dot number during the print operation and the memory stores the sum of the dot number added. The subtracting means operates to subtract a predetermined value from the updated dot number stored in the memory, and the memory stores the dot number subtracted as an updated dot number. That is, a value corresponding to a difference between an amount of heat generated and an amount of heat dissipated is integrated and stored during the print operation. After the print operation, a value corresponding to the amount of heat dissipated is subtracted from the integrated value.

Then, the determining means compares the updated dot number with the reference value as a criterion for stopping the rotation of the cooling fan, and determines whether or not the updated dot number is equal to or less than the reference value. When it is determined that the updated dot number is more than the reference value, the cooling fan control device controls to continuously rotate the cooling fan. In contrast, when it is determined that the updated dot number is equal to or less than the reference value, the cooling fan control device controls to stop the cooling fan or reduce the rotating speed thereof. Accordingly, the cooling fan is rotated at the rated speed even after the print operation for a period of time corresponding to the stored value at the end of the print operation. After the period of time from the end of the print operation, the cooling fan is stopped or rotated at a low speed to reduce noise of the cooling fan.

The invention will be more fully understood from the following detailed description and appended claims when taken with the drawings.

DETAILED DESCRIPTION OF THE PREFERRED EMBODIMENTS

Figure 1:
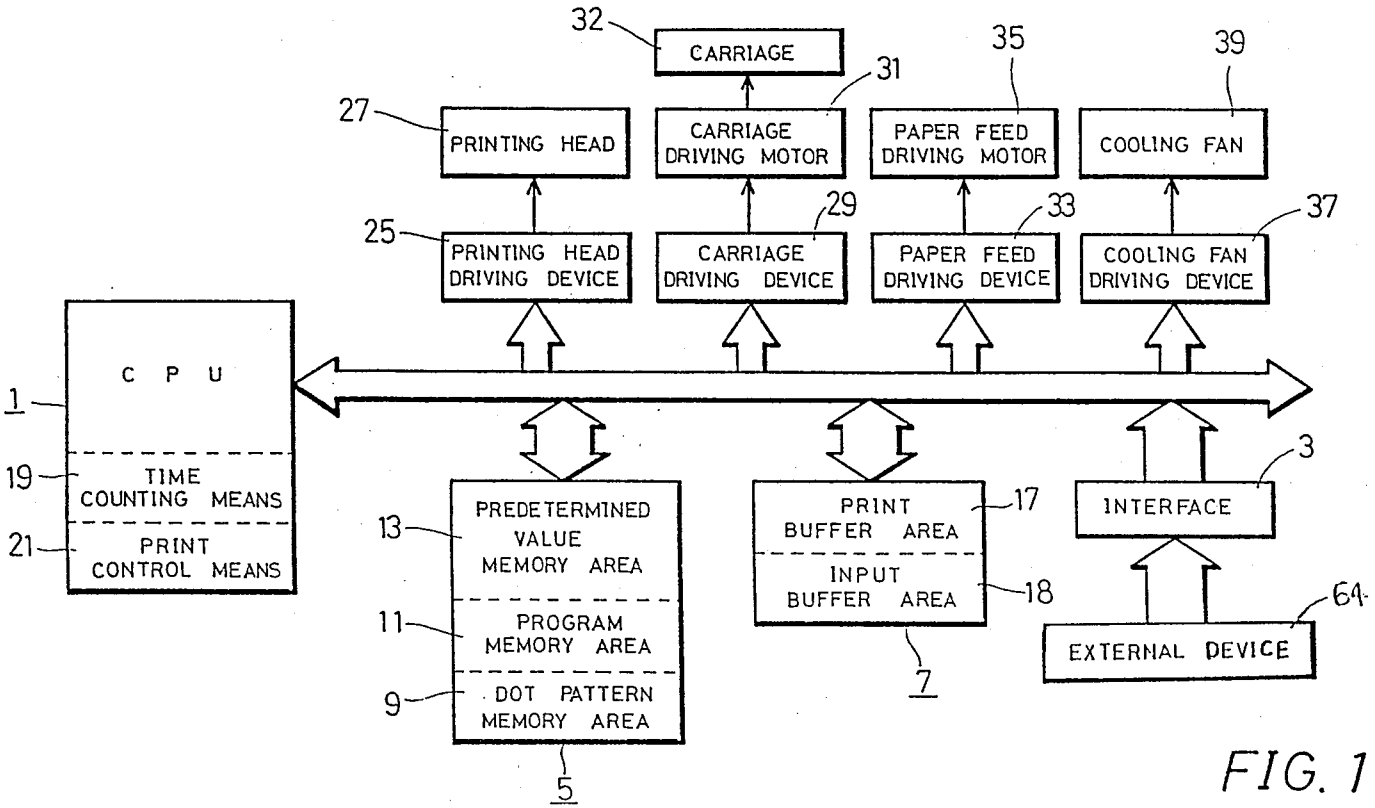
FIG. 1 is a block diagram of a first preferred embodiment according to the present invention.

Referring now to FIG. 1 which shows a control system of the printing device of a first preferred embodiment, reference numeral 1 designates a central processing unit (CPU) connected through an interface 3 to an external device 64 such as a host computer. CPU 1 receives various data such as print data, print command data and paper feed command data from the external device 64.

CPU 1 is also connected with ROM 5 and RAM 7. ROM 5 includes a dot pattern memory area 9, program memory area 11, and predetermined value memory area 13. The dot pattern memory area 9 stores a stack of dot pattern data, wherein each dot pattern data corresponds to the element of print data such as the stack of characters and figures. The program memory area 11 stores a program for executing a print operation. The predetermined value memory area 13 stores data required for print control and data required for cooling fan control.

RAM 7 includes a print buffer area 17 and an input buffer area 18. The input buffer area 18 stores print data to be sequentially inputted from the external device 64. The print buffer area 17 stores a stack of dot pattern data converted from the print data stored in the input buffer area 18 according to dot pattern data stored in the dot pattern memory area 9.

CPU 1 includes a time counting means 19 and a print control means 21. The time counting means 19 starts counting time at the same time when CPU 1 outputs a fan driving signal or a fan stopping signal. The print control means 21 controls a printing head driving device 25, a carriage driving device 29 and a paper feed driving device 33 to effect the print operation of a printing head 27 when receiving a print command from the external device 64.

Figure 6:
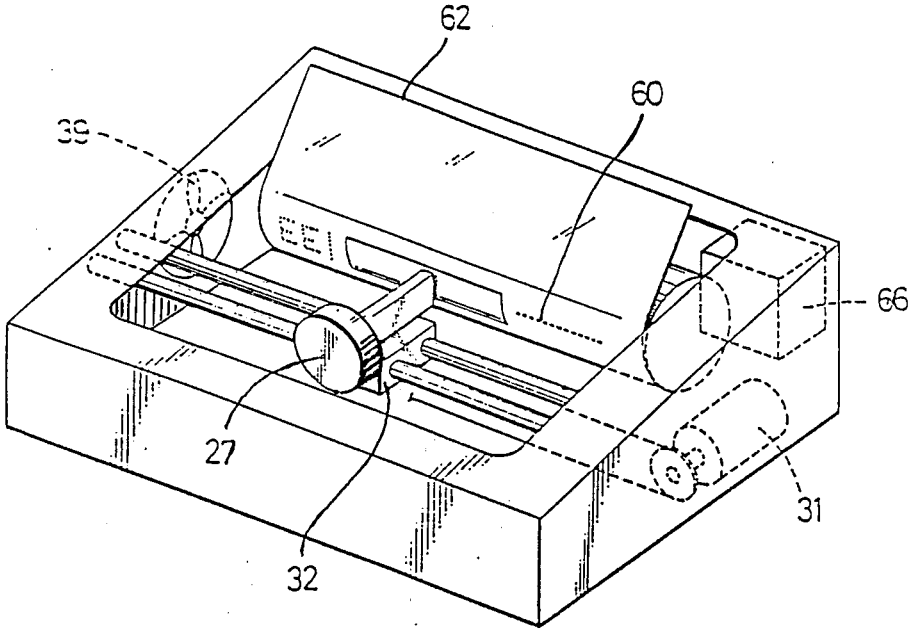
FIG. 6 is a perspective view of the printing device according to the present invention.
Figure 7:
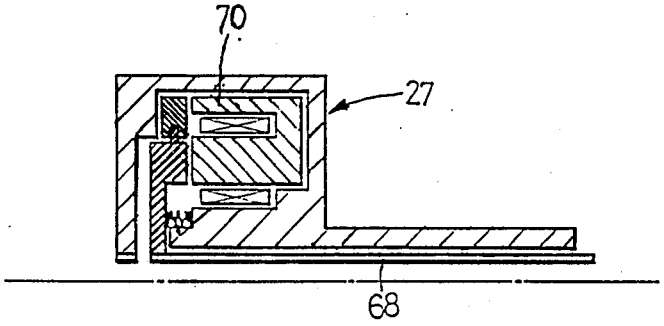
FIG. 7 is a vertical sectional view of the upper half of the printing head of the printing device shown in FIG. 6.

CPU 1 is connected to the printing head driving device 25, which is connected to the printing head 27. The printing head 27 includes a plurality of printing wires 68 (in FIG. 7) arranged in a direction perpendicular to a printing line 60 (in FIG. 6). Each printing wire 68 is incorporated in the printing head 27, and is selectively driven by corresponding electromagnetic devices 70 (in FIG. 7). The printing head 27 is connected to a driving power source 66 (in FIG. 6).

CPU 1 is connected to the carriage driving device 29, which receives a carriage driving signal to drive the carriage driving motor 31. In association with the rotation of the carriage driving motor 31, the carriage 32 mounting the printing head 27 thereon is moved along the printing line 60 (in FIG. 6).

CPU 1 is also connected to the paper feed driving device 33, which receives a paper feed signal to rotate the paper feed driving motor 35. In association with the rotation of the motor 35, a sheet of printing paper 62 (in FIG. 6) is fed.

CPU 1 is further connected to a cooling fan driving device 37, which is connected to a cooling fan 39. The cooling fan driving device 37 receives a fan driving signal from CPU 1 to supply power to the cooling fan 39 to rotate same. When the cooling fan driving device 37 receives a fan stopping signal from CPU 1, it stops the supply of power to the cooling fan 39. The cooling fan 39 serves to radiate heat generated in the printing device because of the operation of the printing head 27, the rotation of the carriage driving motor 31 and/or the paper feed driving motor 35, so as to avoid an increase in temperature of the printing device and an adverse affect on the operation of the printing head 27. The operation of the cooling fan 39 is controlled according to a flow chart as shown in FIG. 2.

Figure 2:
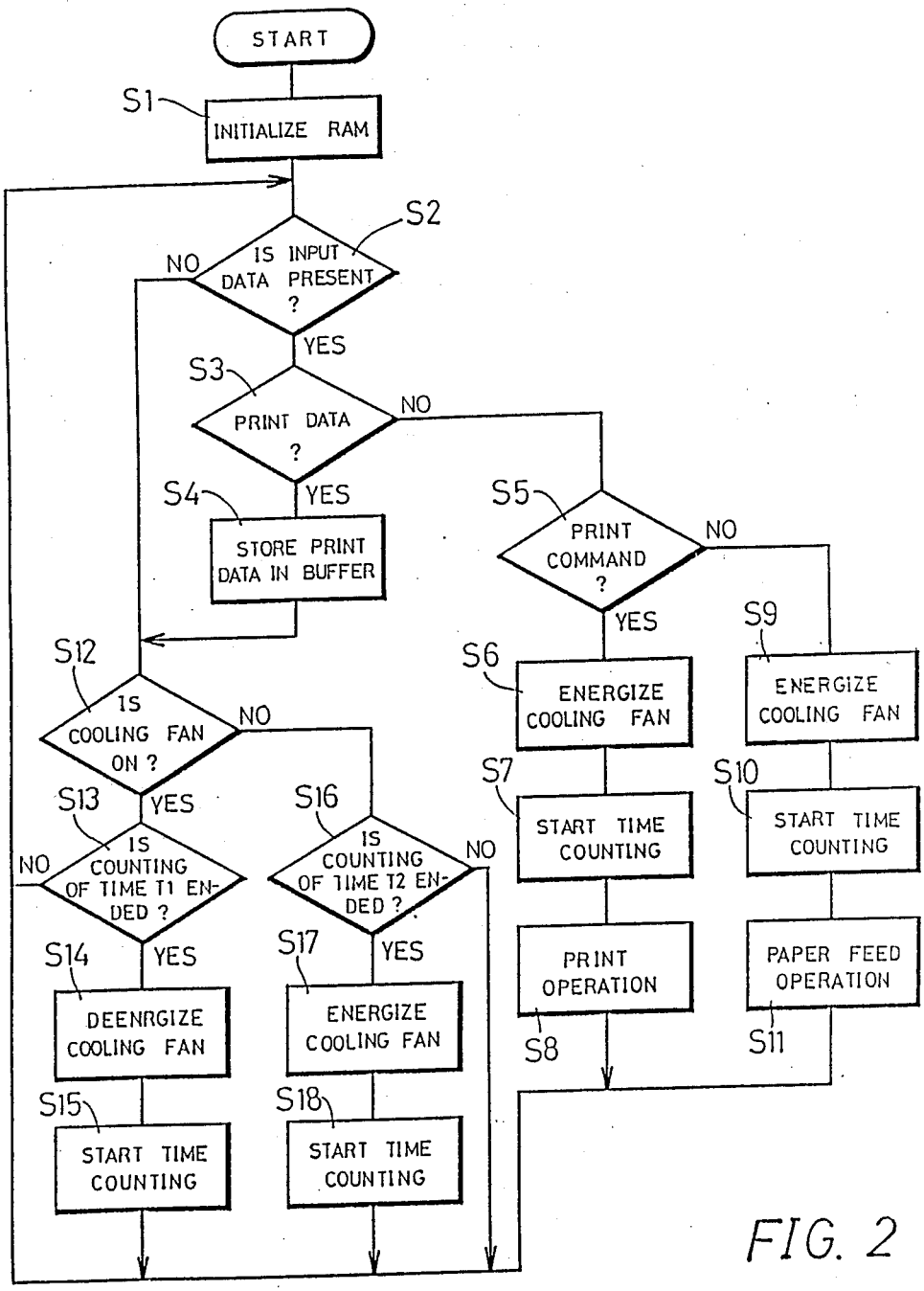
FIG. 2 is a flow chart of the first preferred embodiment.

Referring to FIG. 2, when the required power is supplied to the printing device, CPU 1 reads and executes the program stored in the program memory area 11 of ROM 5. According to the program as read, CPU 1 initializes RAM 7 in step S1. In step S2, CPU 1 determines whether or not an inputted data from the external device 64 is present in the input buffer area 18 of RAM 7. If NO, the program proceeds to step S12. If YES, the program proceeds to step S3. In step S3, CPU 1 determines whether or not the inputted data is a print data. If YES, the program proceeds to step S4. In step S4, CPU 1 converts the print data into a dot pattern data according to dot pattern data stored in the dot pattern memory area 9 of ROM 5, and stores the dot pattern data in the print buffer area 17 of RAM 7. After execution of step S4, the program proceeds to step S12. If the answer is NO in step S3, CPU 1 determines whether or not the input data is a print command in step S5. If the answer is YES in step S5, the program proceeds to step S6. In step S6, CPU 1 outputs a fan driving signal to the cooling fan driving device 37 to rotate the cooling fan 39. In step S7, CPU 1 initializes the time counting means 19 to start counting time. In step S8, the print control means 21 in CPU 1 controls the printing head driving device 25 according to the dot pattern data stored in the print buffer area 17 to selectively drive the printing wires 68 of the printing head 27, and simultaneously controls the carriage driving device 29 to drive the carriage driving motor 31. Thus, the carriage 32 mounting the printing hed 27 thereon is moved along the printing line 60 to print characters or the like on a sheet of printing paper 62. When all the dot pattern data stored in the print buffer area 17 in RAM 7 is printed, the program is returned to step S2.

If the answer is NO in step S5, that is, if the inputted data is a paper feed command, the program proceeds to step S9, and CPU 1 outputs a fan driving signal to the cooling fan driving device 37 to rotate the cooling fan 39 in the same manner as in step S6. In step S10, CPU 1 initializes the time counting means 19 to start counting time. In step S11, CPU 1 controls the paper feed driving device 33 to drive the paper feed driving motor 35, thus carrying out the paper feed operation. After the paper feed operation, the program returns to step S2.

Accordingly, when the print command or the paper feed command continues to be inputted from the external device 64 to CPU 1, the program repeats the loop from step S2 through step S8 or S11 to step S2. As a result, the cooling fan 39 continues to be supplied with power by the cooling fan driving device 37, and rotates at a rated speed. The rated speed is hereinafter referred to as V1. When neither the print operation nor the paper feed operation is carried out, the program proceeds to step S12.

In step S12, CPU 1 determines whether or not the cooling fan 39 is on, that is, whether CPU 1 outputs a fan driving signal or a fan stopping signal to the cooling fan driving device 37. If the answer is YES in step S12, that is, if CPU 1 outputs a fan driving signal, the program proceeds to step S13. If the answer is NO in step S12, that is, if CPU 1 outputs a fan stopping signal, the program proceeds to step S16.

In step S13, CPU 1 determines whether or not the time counting means 19 has counted a time T1. If the answer is NO in step S13, that is, if the time counting means 19 has not ended the counting of the time T1, the program returns to step S2. If the answer is YES in step S13, that is, if the time counting means 19 has ended the counting of the time T1, the program proceeds to step S14. In step S14, CPU 1 outputs a fan stopping signal to the cooling fan driving device 37 to stop the supply of power to the cooling fan 39. In step S15, CPU 1 initializes the time counting means 19 to start the counting of time again. After the execution of step S15, the program returns to step S2.

In step S12, if it is determined that the cooling fan 39 is off, the program proceeds to step S16. In step S16, CPU 1 determines whether or not the time counting means 19 has counted a time T2. If the answer is NO in step S16, that is, if the time counting means 19 has not ended the counting of the time T2, the program returns to step S2. If the answer is YES, that is, if the time counting means 19 has ended the counting of the time T2, the program proceeds to step S17. In step S17, CPU 1 outputs a fan driving signal to the cooling fan driving device 37 to supply power to the cooling fan 39. In step S18, CPU 1 initializes the time counting means 19 to start the counting of time again. After the execution of step S18, the program returns to step S2. The time T1 and the time T2 are set to tens or to hundreds of miliseconds.

Accordingly, when the inputted data from the external device 64 is not present in RAM 7, or the print data only is inputted, the program repeats the loop from step S2 through step S15 or S18 to step S2. According to the program as mentioned above, the energization of the cooling fan 39 for the time T1 and the deenergization for the time T2 are repeated by the cooling fan driving device 37. Accordingly, power to be supplied to the cooling fan 39 is decreased to rotate the fan 39 at a speed V2 lower than the rated speed V1.

As described above, when the print operation and/or the paper feed operation is carried out, the cooling fan 39 is rotated at the high speed V1 to cool the printing device. On the other hand, when the printing device is idling when power is supplied, but neither the print operation nor the paper feed operation is carried out, the cooling fan 39 is rotated at the speed V2 lower than the rated speed V1 to cool the printing device and reduce noise of the cooling fan 39 during idling.

The present invention is not limited to the above preferred embodiment, but various modifications may be made without departing from the spirit of the invention.

In a modified embodiment, the counting time of the time counting means 19 may be so set as to rotate the cooling fan 39 at an intermediate speed V3 between the speeds V1 and V2. Then, the cooling fan 39 is controlled to be rotated at the speed V1 during the print operation, at the speed V3 during the paper feed operation only, and at the speed V2 during idling.

Figure 3:
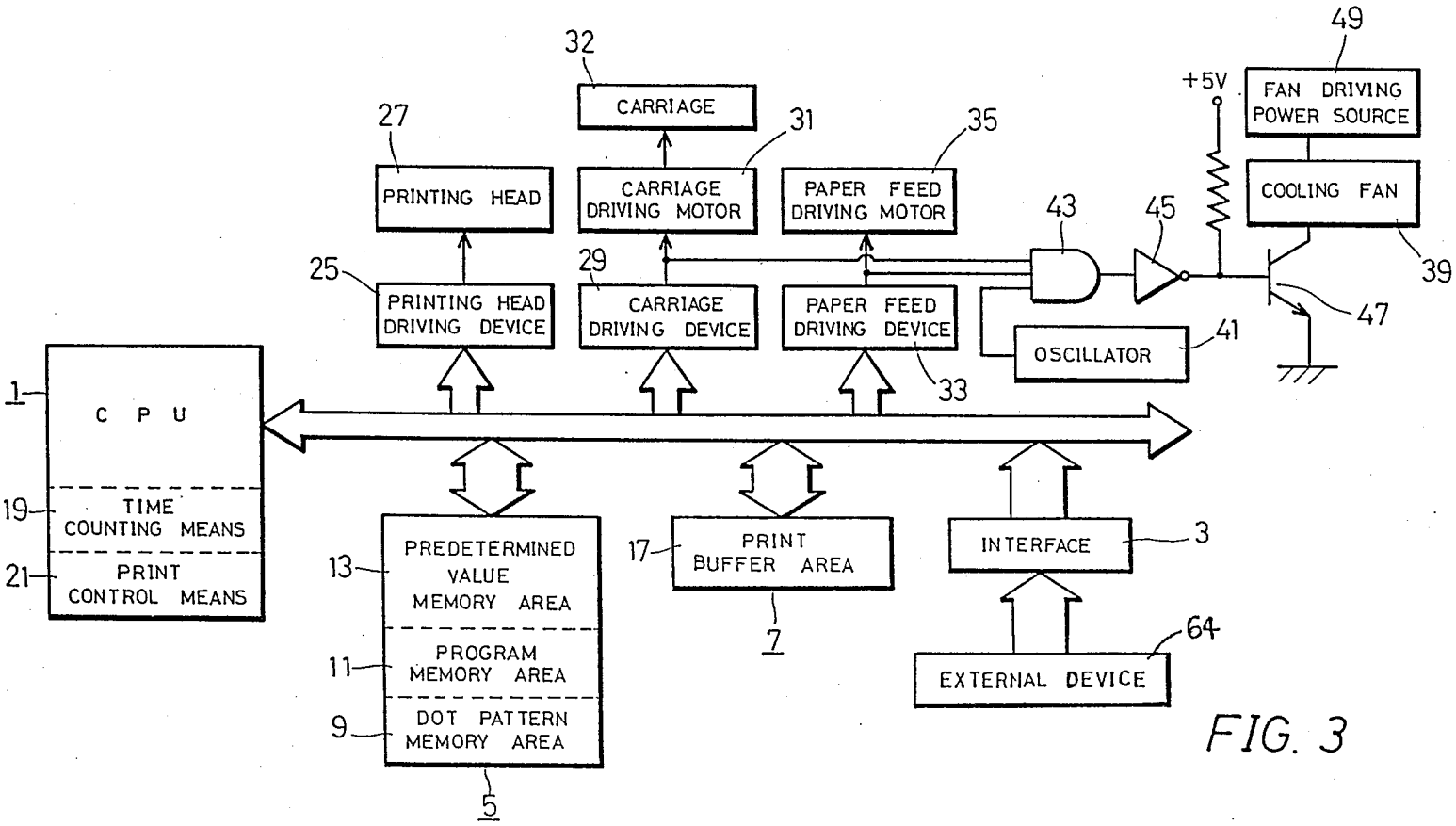
FIG. 3 is a block diagram of a second preferred embodiment according to the present invention.

Referring next to FIG. 3 which shows a second preferred embodiment, the control system includes a circuit comprising an oscillator 4 for generating a pulse signal which is low during the period of time T1 and high during the period of time T2, an AND gate 43 for receiving an output signal from the oscillator 41 and output signals from the carriage driving device 29 and the paper feed driving device 33, and a switching transistor 47 for connecting and disconnecting the power line from a fan driving power source 49 to the cooling fan 39 according to an input signal from the AND gate 43 through an inverter 45 to the transistor 47. When the output signal from the carriage driving device 29 is a low signal, the carriage driving motor 31 is designed to be rotated, for example, and when the output signal from the paper feed driving device 33 is a low signal, the paper feed driving motor 35 is designed to be rotated, for example. Accordingly, when the printing device is in the print operation or in the paper feed operation, at least one of the carriage driving device 29 and the paper feed driving device 33 outputs a low signal. Therefore, the output signal from the AND gate 43 is always a low signal to switch on the transistor 47. Accordingly, during the print operation and/or the paper feed operation, the cooling fan 39 is continuously supplied with power from the fan driving power source 49 to be rotated at the rated speed V1 to thereby cool the printing device intensively. On the other hand, when the printing device is idling where neither the print operation nor the paper feed operation is carried out, both the carriage driving device 29 and the paper feed driving device 33 output a high signal. Accordingly, the output signal from the AND gate 43 is equal to the output signal from the oscillator 41, and the transistor 47 is repeatedly switched on for the period of time T1 and switched off for the time T2. Accordingly, the cooling fan 39 is energized for the period of time T1 in receipt of power from the fan driving power source 49, and is deenergized for the period of time T2 by cutting off the supply of power from the power source 49. This operation is repeated to rotate the cooling fan 39 at the low speed V2, thus cooling the printing device generating a relatively small heat and reducing noise of the cooling fan 39 during idling.

In this way, the second preferred embodiment provides an effect similar to that in the previous embodiment. As an additional effect of the second preferred embodiment, CPU 1 does not directly control the cooling fan 39, and it is therefore possible to reduce the amount of work to be carried out by CPU 1. Accordingly, CPU 1 may process other work more quickly, thereby improving a processing speed of the printing device.

Figure 4:
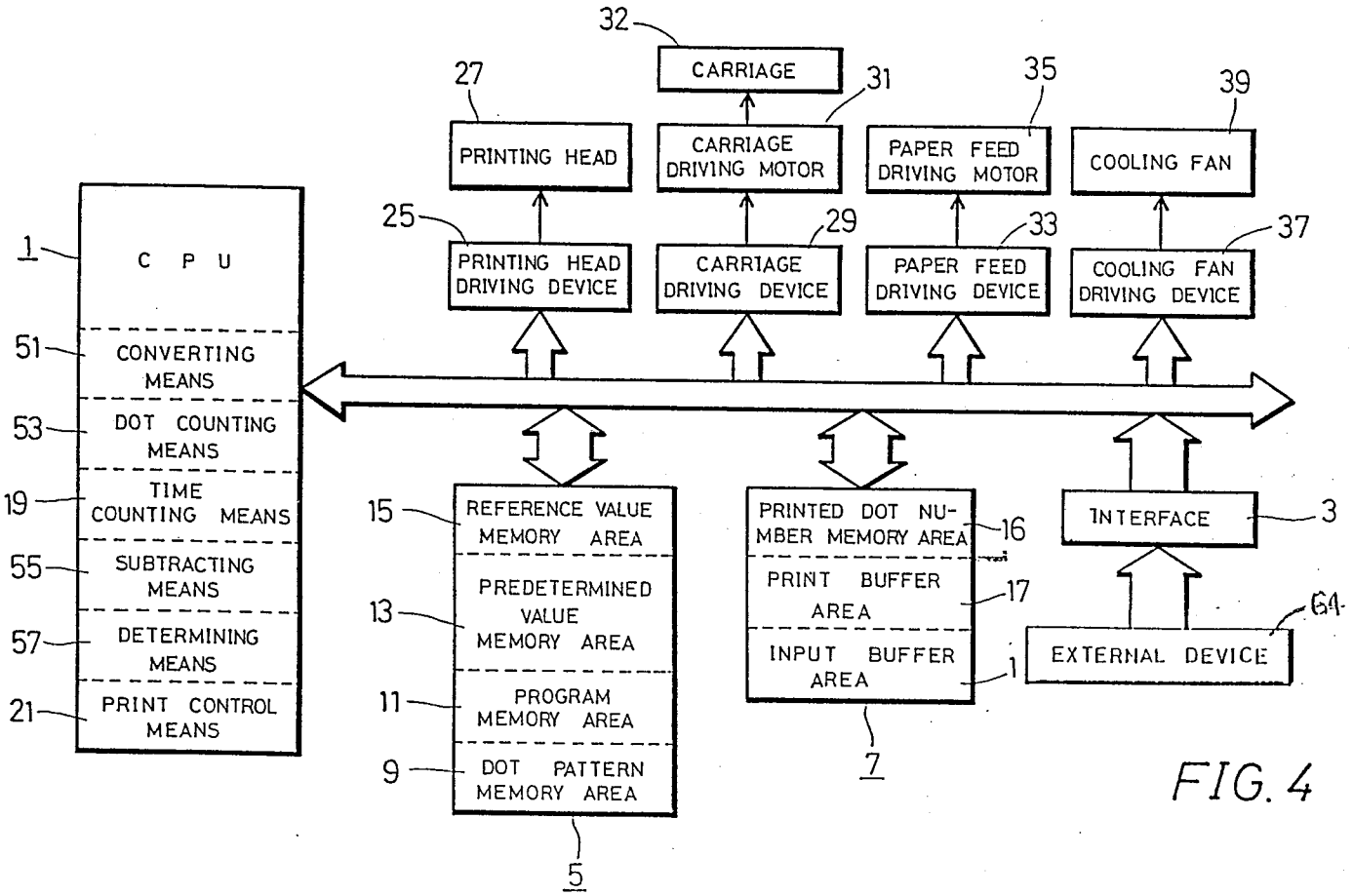
FIG. 4 is a block diagram of a third preferred embodiment according to the present invention.
Figure 5:
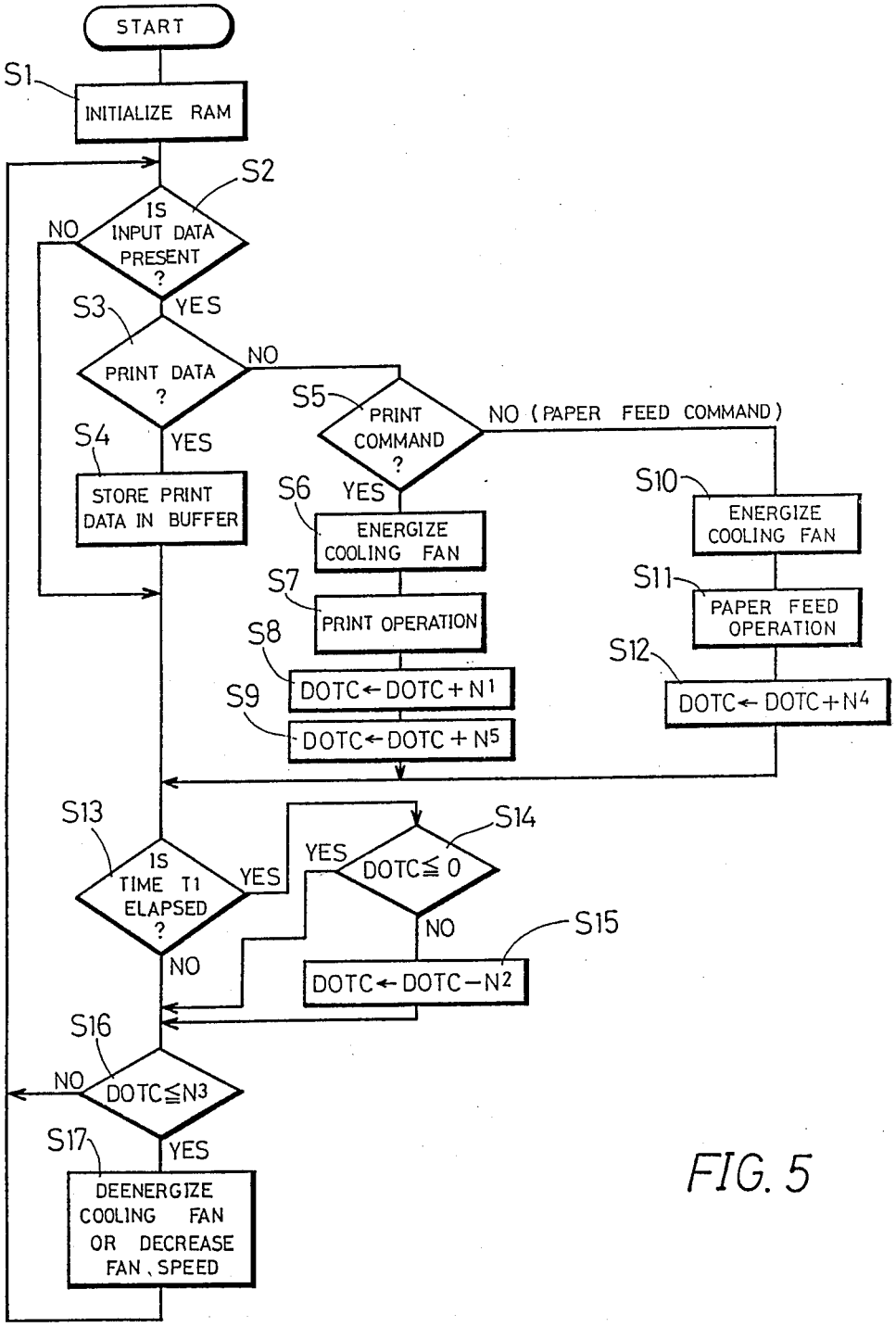
FIG. 5 is a flow chart of the third preferred embodiment.

FIGS. 4 and 5 show a third preferred embodiment of the present invention, in which the same elements as in the previous embodiments are designated by the same reference numerals.

Referring to FIG. 4, ROM 5 includes a dot pattern memory area 9, a program memory area 11, a predetermined value memory area 13, and a reference value memory area 15. The dot pattern memory area 9 stores a stack of dot pattern data, wherein each dot pattern data corresponds to the element of print data such as a stack of characters and figures. The program memory area 11 stores a program for executing a print operation. The predetermined value memory area 13 stores data required for print control and cooling fan control. The reference value memory area 15 stores a reference value as a criterion for continuation or stoppage of the rotation of the cooling fan 39, for example.

RAM 7 includes an input buffer area 18, a print buffer area 17, and a printed dot number memory area 16. The input buffer area 18 stores a print data to be sequentially inputted from the external device 64. The print buffer area 17 stores a stack of dot pattern data converted from the print data stored in the input buffer area 18 according to a dot pattern data stored in the dot pattern memory area 9. The printed dot number memory area 16 stores the number of dots actually printed in accordance with the print operation.

CPU 1 includes a converting means 51, dot counting means 53, time counting or delay means 19, subtracting means 55, determining means 57 and print control means 21. When a carriage driving motor 31 and a paper feed driving motor 35 are driven to be rotated, the converting means 51 in CPU 1 operates to convert an amount of rotation of these motors 31 and 35 to a corresponding printed dot number, that is, the heat generated by the motor rotation and the printing head operation of printing the number of dots is almost equal to each other. Then, the printed dot number as converted is sequentially added to a printed dot number previously stored in the printed dot number memory area 16 in RAM 7. Further, CPU 1 operates to sequentially add the number of dots actually printed according to dot pattern data accessed from the print buffer area 17 to the printed dot number previously stored in the printed dot number memory area 16 in association with the print operation. Further, the time counting means 19 and the subtracting means 55 in CPU 1 operate to count time from when power is supplied in accordance with a predetermined program, and sequentially subtract a predetermined value stored in the predetermined value memory area 13 in ROM 5 from the printed dot number stored in the printed dot number memory area 16 of RAM 7 every predetermined period of time. Further, the determining means 57 in CPU 1 determines whether or not the printed dot number stored in the printed dot number memory area 16 in RAM 7 is equal to or less than a reference value stored in the reference value memory area 15 of ROM 5. If the printed dot number stored in the printed dot number memory area 16 is determined to be greater than the reference value, CPU 1 outputs a driving signal to a cooling fan driving device 37 to continuously rotate the cooling fan 39. In contrast, if the printed dot number stored in the printed dot number memory area 16 is determined to be equal to or less than the reference value, CPU 1 controls and outputs a stopping signal to stop the rotation of the cooling fan 39.

CPU 1 is electrically connected to the cooling fan driving device 37, which is in turn electrically connected to the cooling fan 39. The cooling fan 39 is controlled and operated in accordance with a flow chart shown in FIG. 5.

Referring to FIG. 5, when required power is supplied to the printing device, CPU 1 initializes RAM 7 in step S1. Then in step S2, it is determined whether or not inputted data from the external device 64 is present in RAM 7. If NO, the program proceeds to step S13. If YES, it is determined whether or not the inputted data is print data in step S3. If the answer is YES in step S3, the print data is stored in the input buffer area 18 in step S4. If the answer is NO in step S3, it is determined whether or not the inputted data is a print command in step S5. If the answer is YES in step S5, the cooling fan driving device 37 is controlled to rotate the cooling fan 39 in step S6. Then in step S7, the carriage driving device 29 is controlled to drive the carriage driving motor 31, and the printing head driving device 25 is controlled to move the printing head 27, thus conducting the print operation. In step S8, the number N1 of dots printed in step S7 is counted, and is added to a printed dot number DOTC stored in the printed dot number memory area 16. The sum of DOTC and N1 is stored as a new dot number DOTC in the printed dot number memory area 16. In step S9, a value N5 obtained by converting an amount of rotation of the carriage driving motor 31 to a corresponding printed dot number is added to the printed dot number DOTC newly stored in the printed dot number memory area 16. The sum of DOTC and N5 is stored as a new dot number DOTC in the printed dot number memory area 16.

If the answer is NO in step S5, that is, if the input data is a paper feed command, the cooling fan 39 is rotated in step S10 similar to step S6. Then in step S11, the paper feed driving device 33 is controlled to drive the paper feed driving motor 35, thus conducting the paper feed operation. In step S12, a value N4 obtained by converting an amount of rotation of the paper feed driving motor 35 to a corresponding printed dot number is added to the printed dot number DOTC previously stored in the printed dot number memory area 16. The sum of DOTC and N4 is stored as a new dot number DOTC in the printed dot number memory area 16.

In step S13, it is determined whether or not a predetermined time T1 has elapsed from the beginning of time counting. If the answer is YES, it is determined in step S14 whether or not the updated dot number DOTC stored in the printed dot number memory area 16 is equal to or less than zero. If the answer is NO in step S13, the program proceeds to step S16. If the answer is NO in step S14, a predetermined dot number N2 is subtracted from the DOTC stored in the printed dot number memory area 16 of RAM 7. The resultant value by this subtraction is newly stored in the printed dot number memory area 16 as a new DOTC in step S15.

In step S16, it is determined whether or not the new dot number DOTC is equal to or less than a reference value N3 as a criterion for deciding whether or not the cooling fan 39 should be stopped. If the answer is YES in step S16, the cooling fan driving signal to the cooling fan driving device 37 is cut off to stop the rotation of the cooling fan 39 in step S17. Then, the program is returned to step S2. If the answer is NO in step S16, the program is returned to step S2 and repeats the routine from step S2 to step S16. By repeating the routine from step S2 through step S15 to step S16, the value of DOTC decreases by the step of N2 every T1 period, and the routine is repeated until the value of DOTC becomes equal to or less than N3. Until the DOTC becomes equal to or less than N3, the cooling fan 39 continues to be rotated and thereafter the fan 39 stops. Alternatively, the cooling fan 39 may be rotated at low speeds rather than stopping after the value of DOTC becomes equal to or less than N3. In this case, the duty ratio control program as described in the first preferred embodiment or the duty ratio control circuit as described in the second preferred embodiment may be employed.

As described above, according to the third preferred embodiment, the actual dot number in the print operation and a value obtained by converting the amount of rotation of the carriage driving motor 31 or the paper feed driving motor 35 are added sequentially in the print operation and/or the paper feed operation. Further, a predetermined dot number N2 is subtracted from the sum as obtained previously every time a predetermined period of time is elapsed. Then, the DOTC is compared with the reference value N3 as a criterion for deciding whether or not the cooling fan 39 should be stopped. If it is determined that the DOTC is equal to or less than the reference value N3, the rotation of the cooling fan 39 is stopped or lowered.

In this embodiment, a difference between an amount of heat generted per unit time and an amount of heat dissipated per unit time is integrated until the print operation and/or the paper feed operation are ended. Then, the stoppage of the cooling fan 39 or the low-speed rotation thereof is delayed from the timing that the print operation and/or the paper feed operation are ended for a period of time corresponding to the integrated value as obtained previously.

Although the present invention is applied to a dot printer as mentioned above, it is also applicable to a thermal printer.

What is claimed is:

1. A printing device comprising:

a printing head;

a carriage mounting said printing head thereon;

a carriage driving device for moving said carriage along a printing line;

a paper feed driving device for moving a printing paper in a direction perpendicular to said printing line, wherein various characters and figures are printed on said printing paper by the operation of said printing head and the movements of said carriage and said printing paper in combination;

a cooling fan for cooling said printing device;

a cooling fan driving device for driving said cooling fan;

a cooling fan control device including a determining means for determining if there exists a driving command for driving said carriage driving device, said paper feed driving device or both said devices, wherein when said driving command for said carriage driving device, said paper feed driving device or both devices exists, then said cooling fan is driven at a high speed, and said cooling fan is driven at a low speed at other times, whereby overheating of said printing device during the print operation and the paper feed operation is prevented, and noise of said cooling fan during idling is reduced;

a time counting means for counting elapsed time; and said determining means determining whether or not a predetermined time has elapsed by comparing said elapsed time with said predetermined time and sending a fan driving signal to said cooling fan control device for controlling said cooling fan in such a manner that said cooling fan is repeatedly energized and deenergized every time when said predetermined time has elapsed, whereby said cooling fan rotates at either said low speed or said high speed depending on the existence of said driving command.

2. A printing device comprising:

a printing head;

a carriage mounting said printing head thereon;

a carriage driving device for moving said carriage along a printing line;

a paper feed driving device for moving a printing paper in a direction perpendicular to said printing line, wherein various characters and figures are printed on said printing paper by the operation of said printing head and the movements of said carriage and said printing paper in combination;

a cooling fan for cooling said printing device a cooling fan driving device for driving said cooling fan;

a cooling fan control device including a determining means for determining if there exists a driving command for driving said carriage driving device, said paper feed driving device or both said devices, wherein when said driving command for said carriage driving device, said paper feed driving device or both devices exists, then said cooling fan is driven at a high speed, and said cooling fan is driven at a low speed at other times, wherein overheating of said printing device during the print operation and the paper feed operation is prevented, and noise of said cooling fan during idling is reduced;

an oscillator for generating high and low signals every predetermined time;

an AND circuit for receiving an output from said oscillator, said carriage driving device and said paper feed driving device; and a transistor for receiving an output signal from said AND circuit, said transistor operating to switch on and off a current flowing in said cooling fan so as to decrease the rotating speed of said cooling fan.

3. In a printing device having a cooling fan rotating at a rated speed in a print operation for cooling said printing device; a cooling fan driving control device comprising a delay means for driving said cooling fan for a predetermined time even after the print operation is ended, a storage means for storing a value corresponding to an amount of heat generated in the print operation, said value obtained by adding a printed dot number in the print operation to a previously stored dot number and subtracting a predetermined value from the sum of the printed dot number and the previously stored dot number every predetermined time, and a determining means for determining whether or not a time corresponding to the value stored in said storage means is elapsed, wherein said cooling fan is driven until it is determined that the time has elapsed, and after the time has elapsed, a rotating speed of said cooling fan is decreased down to a value smaller than said rated speed.

4. The cooling fan driving control device as defined in claim 3, wherein the value smaller than the rated speed is set to be zero.

5. The cooling fan driving control device as defined in claim 3, wherein said storage means stores a value obtained by adding a printed dot number in the print operation, a dot number converted at a predetermined rate from an amount of movement of a printing head, and a dot number converted at a predetermined rate from an amount of feed of a printing paper, and subtracting a predetermined value from the sum of the above dot numbers every predetermined time.

6. The cooling fan driving control device as defined in claim 3, wherein said determining means includes a subtracting device for subtracting a predetermined value every predetermined time and a determining device for determining whether or not a value obtained by said subtracting device is equal to or less than a set value, wherein said determining means determines whether or not the time has been elapsed according to the result of determination by said determining device.

7. A printing device comprising:

a printing head;

a carriage mounting said printing head thereon;

a carriage driving device for moving said carriage along a printing line;

a paper feed driving device for moving a printing paper in a direction perpendicular to said printing line; wherein various characters and figures are printed on said printing paper by the operation of said printing head and the movements of said carriage and said printing paper in combination;

a cooling fan for cooling said printing device;

a cooling fan driving device for driving said cooling fan;

a cooling fan control device having a determining means for determining whether or not there exists a driving command to said carriage driving device and said paper feed driving device, and a delay means for setting a delay time, wherein when said driving command to at least one of said carriage driving device and said paper feed driving device exists, said cooling fan is driven at a high speed, while when said delay time is elapsed just after it is determined by said determining means that said driving command to both of said carriage driving device and said paper feed driving device do not exist, said cooling fan is driven at a low speed;

said delay means includes a counter for counting and a subtracting means for subtracting a predetermined value from the sum of a number corresponding to an amount of heat generated in said printing device every predetermined time and storing said subtracted value, wherein said delay time corresponding to a value counted by said counter is elapsed from the timing when it is determined that the driving command to both of said carriage driving device and said paper feed driving device do not exist; and wherein said number corresponding to the amount of heat generated in said device is a sum of actually printed dot number, and said delay means includes said counter for counting and said subtracting means for subtracting the predetermined value from the sum of the number corresponding to the amount of heat generated in said printing device every predetermined time and storing said subtracted value, wherein said delay time corresponding to the value counted by said counter is set at the timing when it is determined that the driving command to both of said carriage driving device and said paper feed driving device do not exist.

8. A printing device comprising:

a printing head;

a carriage mounting said printing head thereon;

a carriage driving device for moving said carriage along a printing line;

a paper feed driving device for moving a printing paper in a direction perpendicular to said printing line; wherein various characters and figures are printed on said printing paper by the operation of said printing head and the movements of said carriage and said printing paper in combination;

a cooling fan for cooling said printing device;

a cooling fan driving device for driving said cooling fan;

a cooling fan control device having a determining means for determining whether or not there exists a driving command to said carriage driving device and said paper feed driving device, and a delay means for setting a delay time, wherein when said driving command to at least one of said carriage driving device and said paper feed driving device exists, said cooling fan is driven at a high speed, while when said delay time is elapsed just after it is determined by said determining means that said driving command to both of said carriage driving device and said paper driving device do not exist, said cooling fan is driven at a low speed;

said delay means includes a counter for counting and a subtracting means for subtracting a predetermined value from the sum of a number corresponding to an amount of heat generated in said printing device every predetermined time and storing said subtracted value, wherein said delay time corresponding to a value counted by said counter is elapsed from the timing when it is determined that the driving command to both of said carriage driving device and said paper feed driving device do not exist; and wherein said number corresponding to the amount of heat generated in said printing device is calculated from an actually printed dot number, a dot number obtained by converting an amount of movement of said carriage at a predetermined rate, and a dot number obtained by converting an amount of feed of said printing paper at a predetermined rate.

* * * * *